US011344946B2

(12) United States Patent
Yamamoto

(10) Patent No.: US 11,344,946 B2
(45) Date of Patent: May 31, 2022

(54) CONTROL DEVICE, CONTROL METHOD, AND PROGRAM FOR CONTROLLING CONTINUOUS CASTING PROCESS

(71) Applicant: NIPPON STEEL CORPORATION, Tokyo (JP)

(72) Inventor: Hiroki Yamamoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 0 days.

(21) Appl. No.: 17/256,778

(22) PCT Filed: Sep. 17, 2019

(86) PCT No.: PCT/JP2019/036347
§ 371 (c)(1),
(2) Date: Dec. 29, 2020

(87) PCT Pub. No.: WO2020/059698
PCT Pub. Date: Mar. 26, 2020

(65) Prior Publication Data

US 2021/0283679 A1 Sep. 16, 2021

(30) Foreign Application Priority Data

Sep. 18, 2018 (JP) ..... JP2018-174009

(51) Int. Cl.
*B22D 11/18* (2006.01)

(52) U.S. Cl.
CPC ..... *B22D 11/186* (2013.01)

(58) Field of Classification Search
CPC ..... B22D 11/16; B22D 11/18; B22D 11/181; B22D 11/186; B22D 46/00
USPC ..... 164/453, 151.3, 449.1, 488, 437
See application file for complete search history.

(56) References Cited

FOREIGN PATENT DOCUMENTS

JP 2007-007722 A 1/2007
JP 2012-159024 A 8/2012

*Primary Examiner* — Kevin P Kerns
(74) *Attorney, Agent, or Firm* — Myers Wolin, LLC

(57) ABSTRACT

A control device for continuous casting continuously producing a slab by injecting a molten metal from a nozzle to a mold and extracting the molten metal while solidifying the molten metal, includes a molten metal level meter measuring a molten metal level in the mold, a main control unit obtaining an operation amount of a flow rate adjusting mechanism that adjusts a flow rate of a molten metal injected to the mold from the nozzle such that a molten metal level measured by the molten metal level meter follows a molten metal level target value, a flowmeter measuring the flow rate of the molten metal injected to the mold from the nozzle, an input disturbance correction unit obtaining a first correction amount for the operation amount of the flow rate adjusting mechanism obtained by the main control unit.

9 Claims, 6 Drawing Sheets

CONTROL DEVICE, CONTROL METHOD, AND PROGRAM FOR CONTROLLING CONTINUOUS CASTING PROCESS

CROSS-REFERENCE TO RELATED APPLICATION

This application is a national stage application of International Application No. PCT/JP2019/036347, filed on Sep. 17, 2019 and designated the U.S., which claims priority to Japanese Patent Application No. 2018-174009, filed on Sep. 18, 2018. The contents of each are herein incorporated by reference.

TECHNICAL FIELD

The present disclosure relates to a control device, a control method, and a program for controlling a continuous casting process.

The present application claims priority based on Japanese Patent Application No. 2018-174009 filed in Japan on Sep. 18, 2018, and the content thereof is incorporated herein.

RELATED ART

In the continuous casting process for a steel, it is important to suppress the fluctuation of the molten metal surface in a mold so as to keep the molten metal level at a constant level, in view of not only preventing the deterioration of the slab quality but also stabilizing the operation. Generally, based on the measured value obtained by one molten metal level meter, a feedback control is performed so as to keep a constant molten metal level.

As a technology in this field, for example, the Patent Document 1, even though the target is not a steelmaking process, discloses a method for controlling a water level of steam turbine condenser. In this Patent Document 1, a deviation signal of a steel flow rate at an inlet of a steam turbine measured by a turbine inlet steam flowmeter and a condensation flow rate measured by a condensation flowmeter is converted into a condenser level control correction amount corresponding to an opening degree of a condenser level control valve to be added to output of PID control performing constant value control, so that the condenser level control valve is controlled.

CITATION LIST

Patent Documents

[Patent Document 1] Japanese Unexamined Patent Application, First Publication No. 2012-159024

[Patent Document 2] Japanese Unexamined Patent Application, First Publication No. 2007-7722

SUMMARY

Problems to be Solved

In the continuous casting process, two-type disturbances may occur; that is, one is a disturbance of a nozzle clogging or the like which fluctuates the flow rate of the molten steel injected to the mold, and the other is a disturbance of a volume fluctuation or the like caused by unsteady bulging which fluctuates the molten metal level in the mold. In the Patent Document 1, a configuration in which the control correction amount is added to the output of PID control performing constant value control is disclosed, but if this control is applied to the continuous casting process, the control performance of the molten steel level deteriorates, in particular when the latter disturbance is occurred.

The present disclosure is achieved in view of the above-described points, and an object thereof is to accurately control a molten metal level in a mold even in a case where a plurality of disturbances occurred in the continuous casting process.

Means for Solving the Problem

The gist of the present disclosure for solving the above-described problem is as follows.

(1) A first aspect of the present disclosure is a control device for a continuous casting process which is configured to continuously produce a slab by injecting a molten metal from a nozzle to a mold and extracting the molten metal while solidifying the molten metal, the control device including: a molten metal level meter that is configured to measure a molten metal level in the mold, a main control unit that is configured to obtain an operation amount of a flow rate adjusting mechanism that adjusts a flow rate of the molten metal injected to the mold from the nozzle such that the molten metal level measured by the molten metal level meter follows a molten metal level target value, a flowmeter that is configured to measure the flow rate of the molten metal injected to the mold from the nozzle, an input disturbance correction unit that is configured to obtain a first correction amount for the operation amount of the flow rate adjusting mechanism obtained by the main control unit, in accordance with an input disturbance estimation value obtained according to a flow rate measurement value of the molten metal measured by the flowmeter, and an extraction disturbance correction unit that is configured to obtain a second correction amount for the operation amount of the flow rate adjusting mechanism obtained by the main control unit, in accordance with an extraction disturbance estimation value obtained according to the molten metal level measurement value measured by the molten metal level meter.

(2) The control device for a continuous casting process according to the above (1) may further include an flow rate estimation unit that is configured to calculate a flow rate estimation value of a molten steel associated with an opening degree using a flow rate characteristic model indicating a relationship between the operation amount of the flow rate adjusting mechanism and the flow rate of the molten metal, wherein the input disturbance correction unit is configured to use a difference between the flow rate measurement value of the molten metal measured by the flowmeter and a flow rate estimation value of the molten metal calculated by the flow rate estimation unit as the input disturbance estimation value, and obtain the first correction amount according to the input disturbance estimation value.

(3) In the control device for a continuous casting process according to the above (2), the input disturbance correction unit may obtain the first correction amount by using an inverse model of the flow rate characteristic model.

(4) In the control device for a continuous casting process according to the above (2) or (3), the extraction disturbance correction unit may obtain the second correction amount by using an inverse model of the flow rate characteristic model.

(5) The control device for a continuous casting process according to any one of the above (1) to (4) may include an extraction disturbance estimation unit that is configured to obtain the extraction disturbance estimation value by configuring a Luenberger-type observer in which the molten metal level and an extraction disturbance are state variables, using a process model indicating a response to the molten metal level with respect to a flow rate of the molten metal, using the flow rate measurement value of the molten metal measured by the flowmeter and the molten metal level measurement value measured by the molten metal level meter as inputs, wherein the extraction disturbance correction unit is configured to obtain the second correction amount in accordance with the extraction disturbance estimation value obtained by the extraction disturbance estimation unit.

(6) In the control device for a continuous casting process according to any one of the above (1) to (5), the flowmeter may be an electromagnetic flowmeter.

(7) A second aspect of the present disclosure is a control method for a continuous casting process which is configured to continuously produce a slab by injecting a molten metal from a nozzle to a mold and extracting the molten metal while solidifying the molten metal, the control method including: a molten metal level measuring process of measuring a molten metal level in the mold by using a molten metal level meter, a main control process of obtaining an operation amount of a flow rate adjusting mechanism that adjusts a flow rate of a molten metal injected to the mold from the nozzle such that the molten metal level measured in the molten metal level measuring process follows a molten metal level target value, a flow rate measuring process of measuring the flow rate of the molten metal injected to the mold from the nozzle by a flowmeter, an input disturbance correcting process of obtaining a first correction amount for the operation amount of the flow rate adjusting mechanism obtained by the main control process, in accordance with an input disturbance estimation value obtained according to the flow rate measurement value of the molten metal measured in the flow rate measuring process, and an extraction disturbance correcting process of obtaining a second correction amount for the operation amount of the flow rate adjusting mechanism obtained by the main control process, in accordance with an extraction disturbance estimation value obtained according to the molten metal level measurement value measured by the molten metal level meter.

(8) A program for controlling a continuous casting process of continuously producing a slab by injecting a molten metal from a nozzle to a mold and extracting the molten metal while solidifying the molten metal, the program configured to allow a computer to execute: a main control process of obtaining an operation amount of a flow rate adjusting mechanism that adjusts a flow rate of the molten metal injected to the mold from the nozzle such that a molten metal level measured by a molten metal level meter follows a molten metal level target value, an input disturbance correcting process of obtaining a first correction amount for the operation amount of the flow rate adjusting mechanism obtained by the main control process, in accordance with an input disturbance estimation value obtained according to the flow rate measurement value of the molten metal measured by the flowmeter, and an extraction disturbance correcting process of obtaining a second correction amount for the operation amount of the flow rate adjusting mechanism obtained by the main control process, in accordance with an extraction disturbance estimation value obtained according to the molten metal level measurement value measured by the molten metal level meter.

Effects

According to the present disclosure, it is possible to accurately control a molten metal level in a mold even in a case where a plurality of disturbances occurred in the continuous casting process. Therefore, it is possible to increase the quality of the slab and stabilize the operation.

DETAILED DESCRIPTION

Hereinafter, a control device 100 for a continuous casting process according to an embodiment of the present disclosure will be described with reference to the accompanying drawings.

Figure 1:
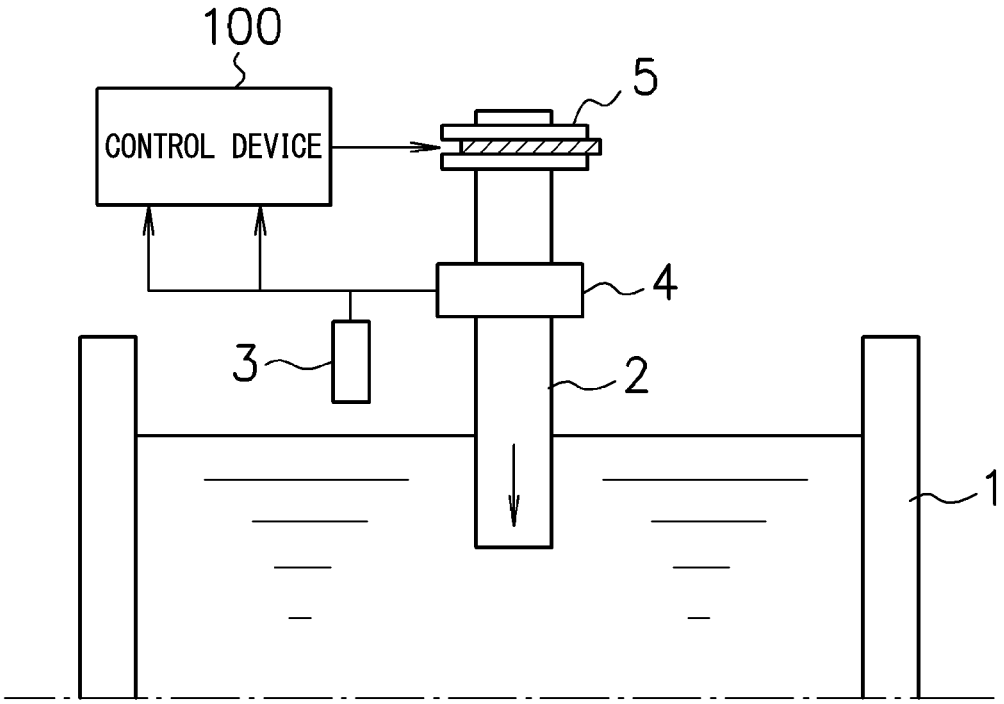
FIG. 1 is a schematic diagram illustrating a control system including a control device for a continuous casting process according to an embodiment of the present disclosure.

FIG. 1 illustrates a schematic diagram of a control system for a continuous casting process including the control device 100 for the continuous casting process and a continuous casting equipment to be controlled.

The continuous casting equipment includes a mold 1 and an immersion nozzle 2. A molten steel is injected to the mold 1 from a tundish (not shown) via the immersion nozzle 2. The mold 1 is configured to be cooled by water, thus, the molten metal can be started to be solidified when contacted with the mold. The slab is continuously produced by injecting the molten steel to the mold 1 from the immersion nozzle 2, and extracting the molten metal while being solidified.

In the vicinity of the molten metal surface in the mold 1, a molten metal level meter 3 is installed which measures the molten metal level in the mold 1. In addition, the immersion nozzle 2 is provided with an in-nozzle flowmeter 4 which measures the flow rate of the molten steel injected into the mold 1. The molten metal level measurement value (that is, actual result of the molten metal level) which is measured by the molten metal level meter 3, and the flow rate measurement value of the molten steel (that is, actual result of the flow rate of the molten steel) which is measured by the in-nozzle flowmeter 4 are input to the control device 100. As the in-nozzle flowmeter 4, for example, an electromagnetic flowmeter may be used.

The flow rate of the molten steel injected into the mold 1 from the immersion nozzle 2 is adjusted in accordance with the opening degree of the sliding gate 5 which functions as a flow rate adjusting mechanism (operation end) to adjust the flow rate of the molten steel. The opening degree of the sliding gate 5 is operated under the control of the control device 100. The sliding gate 5 is used in the example shown in FIG. 1, but a configuration of using a stopper mechanism may be used for adjusting the molten steel injection flow rate from the immersion nozzle 2.

Figure 2:
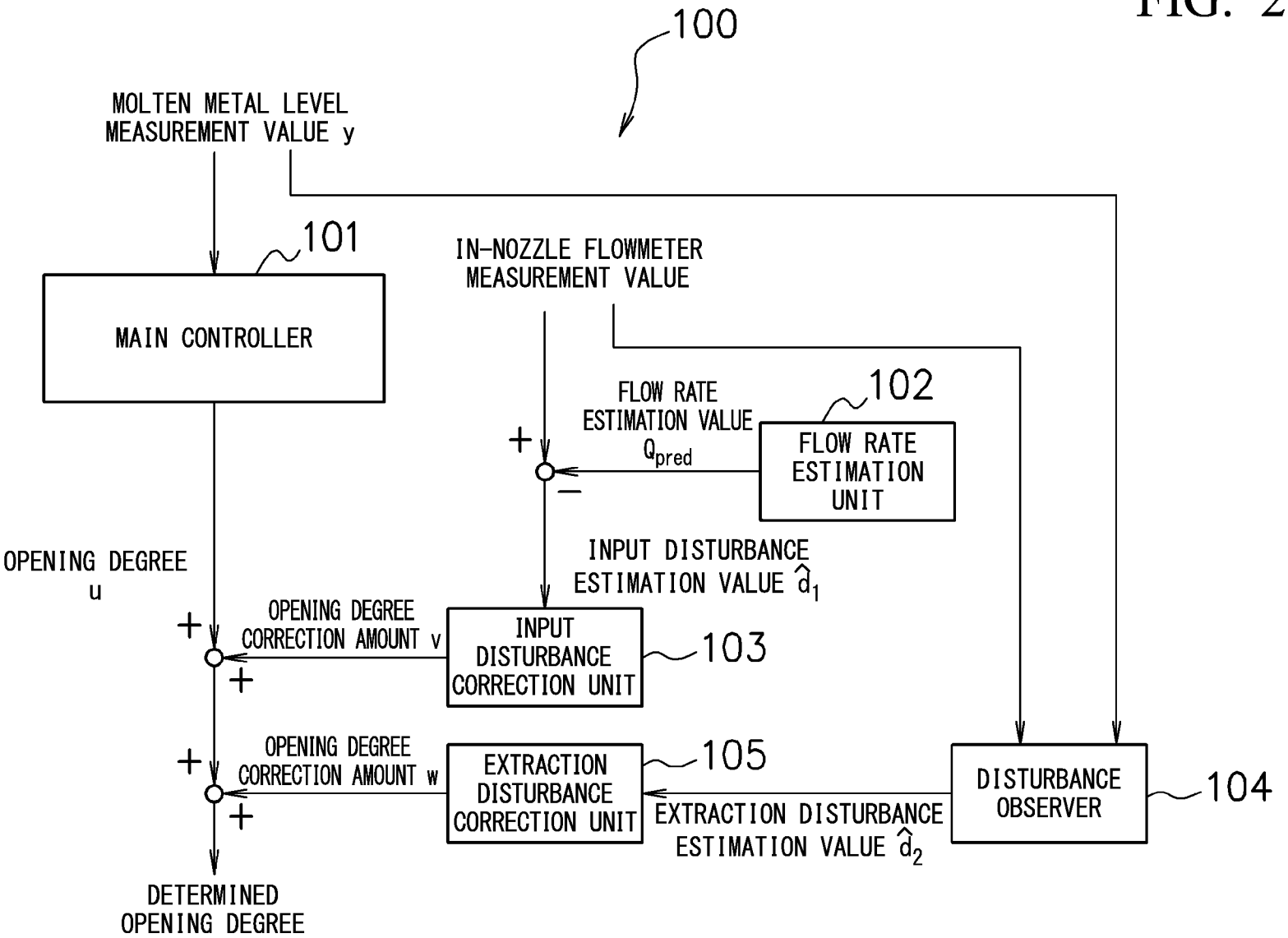
FIG. 2 is a diagram illustrating a configuration of the control device for a continuous casting process according to the same embodiment.

FIG. 2 indicates a configuration of the control device 100 for a continuous casting process according to this embodiment. The control device 100 includes a main controller 101 (a main control unit), a flow rate estimation unit 102, an input disturbance correction unit 103, a disturbance observer 104, and an extraction disturbance correction unit 105.

The main controller 101 obtains an opening degree u of the sliding gate 5 such that a molten metal level measurement value y measured by the molten metal level meter 3 follows a molten metal level target value. In this way, a feedback control is performed so as to keep the constant molten metal level. Hereinafter, the opening degree of the sliding gate 5 is simply called as the opening degree.

The flow rate estimation unit 102 calculates a flow rate estimation value $Q_{pred}$ of the molten steel associated with the present opening degree, using a flow rate characteristic model indicating a relationship between an opening degree and the flow rate of the molten steel.

The input disturbance correction unit 103 obtains an opening degree correction amount v for the opening degree u, in accordance with an input disturbance estimation value $d_1\hat{}$; here, the input disturbance estimation value $d_1\hat{}$ is defined by a difference between the flow rate measurement value Q of the molten steel measured by the in-nozzle flowmeter 4, and the flow rate estimation value $Q_{pred}$ of the molten steel calculated by the flow rate estimation unit 102. The way of obtaining the input disturbance estimation value $d_1\hat{}$ is not limited to above manner, and another way may be used as long as the value can be obtained by using the flow rate measurement value Q. It should be noted that the expression of $d_1\hat{}$ means that the sign ^ is provided above the expression of $d_1$. Here, the disturbance which fluctuates the flow rate of the molten steel injected into the mold 1 from the immersion nozzle 2 is referred to as an input disturbance. As the input disturbance, the disturbance due to a nozzle defect, a nozzle clogging, a clog peeling, a nozzle erosion, or other trouble is assumed.

The disturbance observer 104 (extraction disturbance estimation unit) obtains an extraction disturbance estimation value $d_2\hat{}$ based on the flow rate measurement value Q of the molten metal measured by the in-nozzle flowmeter 4 and a molten metal level measurement value y measured by the molten metal level meter 3. Here, the disturbance which affects the downstream side than the mold 1 in the continuous casting equipment to be controlled, and fluctuates the molten steel volume balance in the mold 1 to give an influence on the molten metal level is referred to as an extraction disturbance. As the extraction disturbance, the disturbance due to a casting speed error, the volume fluctuation caused by unsteady bulging, or other trouble is assumed. The cast speed error means a difference between the actual result value of the cast speed measured from the rotation ratio or the like of the roller and the actual cast speed in the mold. Generally, in the molten metal level control, at the time of changing the cast speed, the opening degree of the flow rate adjusting mechanism is corrected based on the correction coefficient preliminary calculated in accordance with the changed amount of the casting speed. If the casting speed error exists, the extraction disturbance occurs. The term of unsteady bulging means a bulging of the slab in which the slab periodically changes in accordance with the roll pitch interval.

The extraction disturbance correction unit 105 obtains the opening degree correction amount w for the opening degree u, in accordance with the extraction disturbance estimation value $d_2\hat{}$ obtained by the disturbance observer 104.

As explained above, in the control device 100, the opening degree is determined by the opening degree u which is obtained by the main controller 101, and the opening degree correction amount v and the opening degree correction amount w which are obtained by the input disturbance correction unit 103 and the extraction disturbance correction unit 105, whereby the opening degree operation for the sliding gate 5 is performed so as to realize this determined opening degree.

Figure 3:
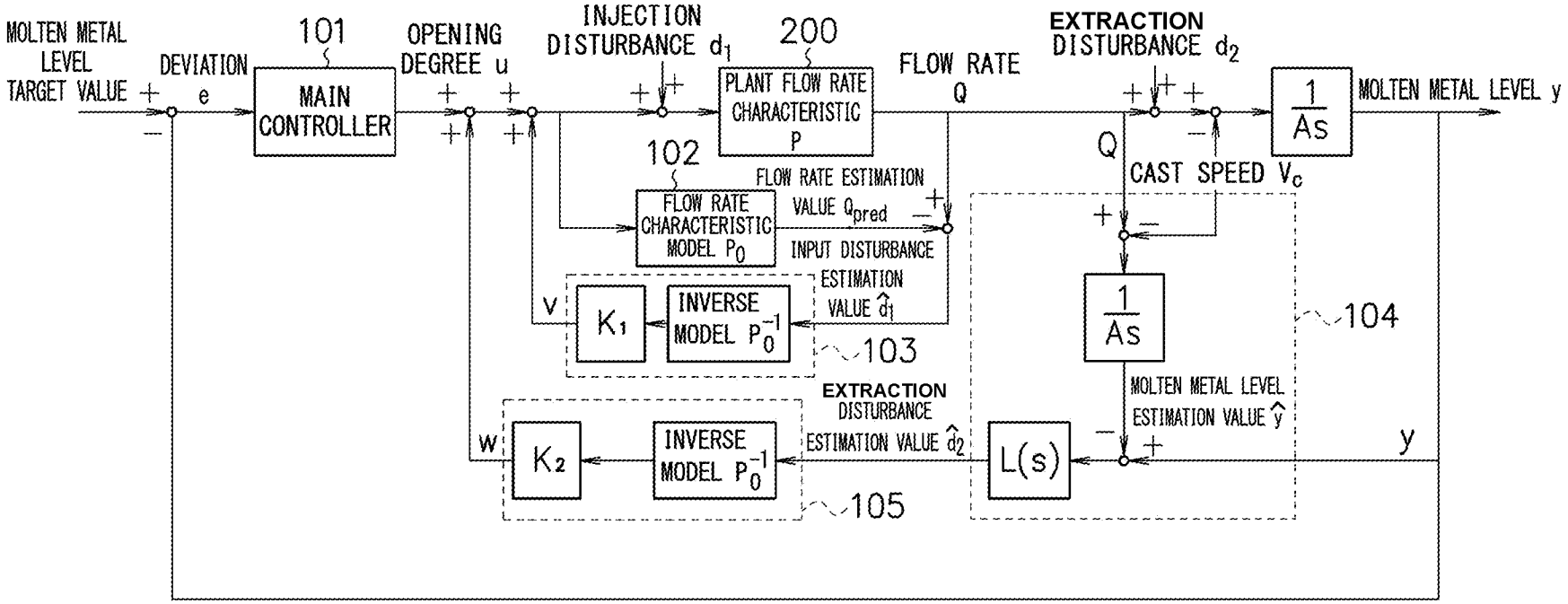
FIG. 3 is a block diagram of a control system of the control device for a continuous casting process according to the same embodiment.

FIG. 3 illustrates a block diagram indicating the control system of the continuous casting process.

The main controller 101 uses a deviation e of the molten metal level target value and the molten metal level measurement value y as an input, and obtains the opening degree u so that the deviation e becomes zero (0), in other words, so that the molten metal level measurement value y follows the molten metal level target value as explained above.

In the real plant (continuous casting equipment) 200 to be controlled, the flow rate Q is determined by the plant flow rate characteristic P of the plant, in accordance with the present opening degree (u+v+w) and the present input disturbance $d_1$. Then, the molten metal level y is determined in accordance with the present flow rate Q, the present extraction disturbance $d_2$, and the present cast speed $V_c$. Note that the A means the cross sectional area of the mold 1, and the s means Laplace operator.

The flow rate estimation unit 102 calculates, as indicated in the Equation (1), a flow rate estimation value $Q_{pred}$ of a molten steel associated with the present opening degree (u+v+w) using a flow rate characteristic model $P_0$ which is a nominal model indicating a relationship between the opening degree and the flow rate of the molten steel. The flow rate characteristic model $P_0$ is provided as a non-linear function, but this may be generally approximated to a straight line by a linearization around the opening degree operating point.

Then, as indicated in the Equation (2), the difference between the flow rate measurement value Q of the molten steel and the flow rate estimation value $Q_{pred}$ of the molten steel is defined as the input disturbance estimation value $d_1\hat{}$. In this way, by comparing the flow rate measurement value Q of the molten steel including the input disturbance $d_1$ and the flow rate estimation value $Q_{pred}$ of the molten steel not including the input disturbance $d_1$, it is possible to estimate the input disturbance $d_1$.

[Formula 1]

$$Q_{pred}=P_0(u+v+w) \tag{1}$$

$$\hat{d}_1=Q-Q_{pred} \tag{2}$$

The input disturbance correction unit 103, as indicated in the Equation (3), obtains an opening degree correction amount v so as to cancel the input disturbance estimation value $d_1\hat{}$, by using an inverse model of the flow rate characteristic model $P_0$ (relational equation indicating the opening degree with respect to the given flow rate), and using an opening degree correction gain $K_1$. As similar to the flow rate characteristic model $P_0$, the inverse model $P_0^{-1}$ is provided as a non-linear function; this may be generally approximated to a straight line by a linearization around the opening degree operating point.

[Formula 2]

$$v=-K_1P_0^{-1}(\hat{d}_1) \tag{3}$$

The disturbance observer 104 is configured by a Luenberger-type observer in which a process model 1/As indicating the response of the molten metal level with respect to the flow rate of the molten steel, and in which the molten metal level and the extraction disturbance are used as state variables. The gist of the calculation in the disturbance observer 104 will be explained below. By using the process model 1/As indicating a response of the molten metal level, the molten metal level estimation value $y^\wedge$ in accordance with the present flow rate measurement value Q of the molten steel is calculated, and then an extraction disturbance estimation value $d_2^\wedge$ is obtained based on the difference between the molten metal level measurement value y and the molten metal level estimation value $y^\wedge$. Comparing the molten metal level measurement value y including the extraction disturbance $d_2$ and the molten metal level estimation value $y^\wedge$ not including the extraction disturbance $d_2$ in this manner, the extraction disturbance $d_2$ may be estimated. It may be possible to formulate considering a factor of a molten steel drop dead time to the process model 1/As. Further, the way of obtaining the extraction disturbance estimation value $d_2^\wedge$ is not limited to the above manner, and another way may be used as long as the value can be obtained by using the molten metal level measurement value y.

Specifically, assuming a step disturbance as the extraction disturbance, the disturbance observer is formulated as indicated in the Equation (4). $L_1$ and $L_2$ are observer gains. In this case, the transfer function from the flow rate measurement value Q of the molten steel and the molten metal level measurement value y to the extraction disturbance estimation value $d_2^\wedge$ is expressed as indicated in the Equation (5). As the extraction disturbance, generally, the step disturbance is assumed, but a lamp shape disturbance or a periodic disturbance may be assumed.

[Formula 3]

$$\frac{d}{dt}\begin{pmatrix}\hat{y}\\ \hat{d}_2\end{pmatrix}=\begin{pmatrix}0 & \frac{1}{A}\\ 0 & 0\end{pmatrix}\begin{pmatrix}\hat{y}\\ \hat{d}_2\end{pmatrix}+\begin{pmatrix}L_1\\ L_2\end{pmatrix}(y-\hat{y})+\begin{pmatrix}\frac{Q}{A}\\ 0\end{pmatrix} \tag{4}$$

$$\hat{d}_2=\frac{L_2 s}{s^2 * L_1 s+\frac{L_2}{A}}\left(y-\frac{Q}{As}\right) \tag{5}$$

The value y−Q/As corresponds to a "prediction error" of the molten metal level; the value obtained by applying the secondary filter L(s) to this value becomes the extraction disturbance estimation value $d_2^\wedge$. The filter L(s) is expressed as indicated in the Equation (6). The filter characteristic of the filter L(s) may be suitably designed in accordance with the assumed frequency range of the extraction disturbance. For example, if the peak frequency of the extraction disturbance is previously assumed like in a case of the unsteady bulging, a suitable band pass filter including that peak frequency may be designed.

[Formula 4]

$$L(s)=\frac{L_2 s}{s^2+L_1 s+\frac{L_2}{A}} \tag{6}$$

The extraction disturbance correction unit 105, as indicated in the Equation (7), obtains an opening degree correction amount w so as to cancel the extraction disturbance estimation value $d_2^\wedge$, by using an inverse model $P_0^{-1}$ of the flow rate characteristic model $P_0$, and using an opening degree correction gain $K_2$. As similar to the flow rate characteristic model $P_0$, the inverse model $P_0^{-1}$ is provided as the non-linear function; this may be generally approximated to a straight line by a linearization around the opening degree operating point.

[Formula 5]

$$w=-K_2 P_0^{-1}(\hat{d}_2) \tag{7}$$

The opening degree correction gains $K_1$ and $K_2$ are not limited to the positive constant, and for example, PD controller may be used. The opening degree correction gains $K_1$ and $K_2$ may be designed to be varied.

As explained above, in the control system performing a feedback control so as to keep the molten metal level constantly, by adding a minor loop suppressing an input disturbance (loop including the input disturbance correction unit 103) and a minor loop suppressing an extraction disturbance (loop including the extraction disturbance correction unit 105), it is possible to accurately control the molten metal level so as to cancel the input disturbance and the extraction disturbance. Therefore, it is possible to increase the quality of the slab and stabilize the operation.

Further, the input disturbance and the extraction disturbance can be estimated independently, thus, it is possible to suppress the deterioration of the control performance for each disturbance. Then, because the estimation value of the input disturbance $d_1$ is obtained, it is possible to use this value to detect a nozzle defect, a nozzle clogging, a clog peeling, a nozzle erosion or other troubles, and thus the countermeasure actions may be taken to stabilize the operation (for example, actions of changing the cast speed and changing the set value of an electromagnetic force device). Further, because the estimation value of the extraction disturbance $d_2$ is obtained, it is possible to use this value in combination with the control method of suppressing the periodic disturbance as disclosed in the Patent Document 2, for example, to suppress the periodic disturbance more effectively.

In order to confirm the effects of applying the present disclosure, simulations of the molten metal level control were carried out.

[Simulation Conditions of the Inventive Method Employing the Present Disclosure]

Assuming typical casting conditions for a continuous casting equipment for manufacturing slabs, the following simulation conditions were set to perform the simulations of molten metal level control.

The mold width was set to 1250 mm, the mold thickness was set to 270 mm, the casting speed was set to 1.5 m/m, and the molten steel drop dead time was set to 0.3 sec.

Figure 4:
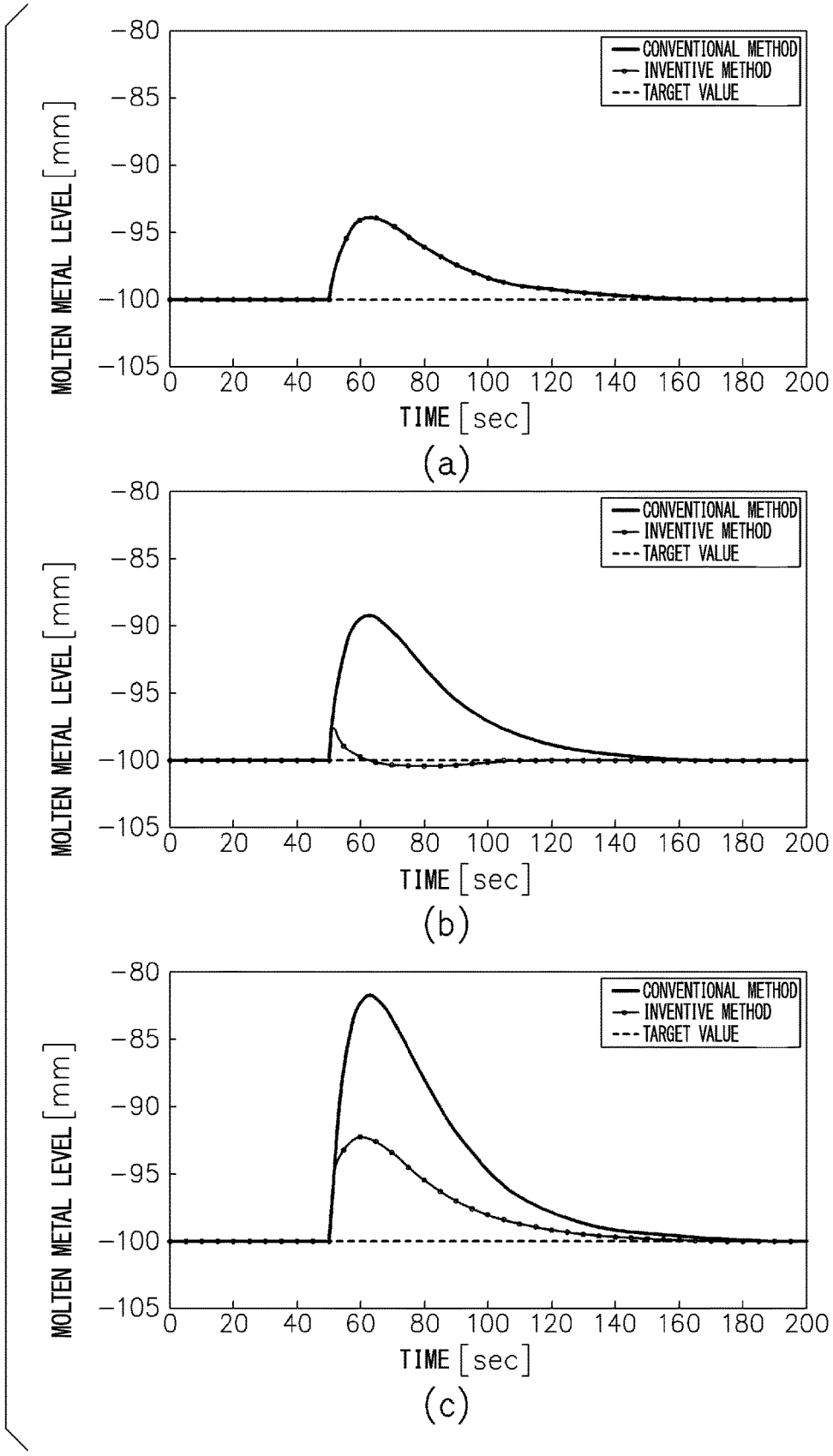
FIG. 4 is a characteristic diagram illustrating simulation results comparing an inventive method and a conventional method.
Figure 5:
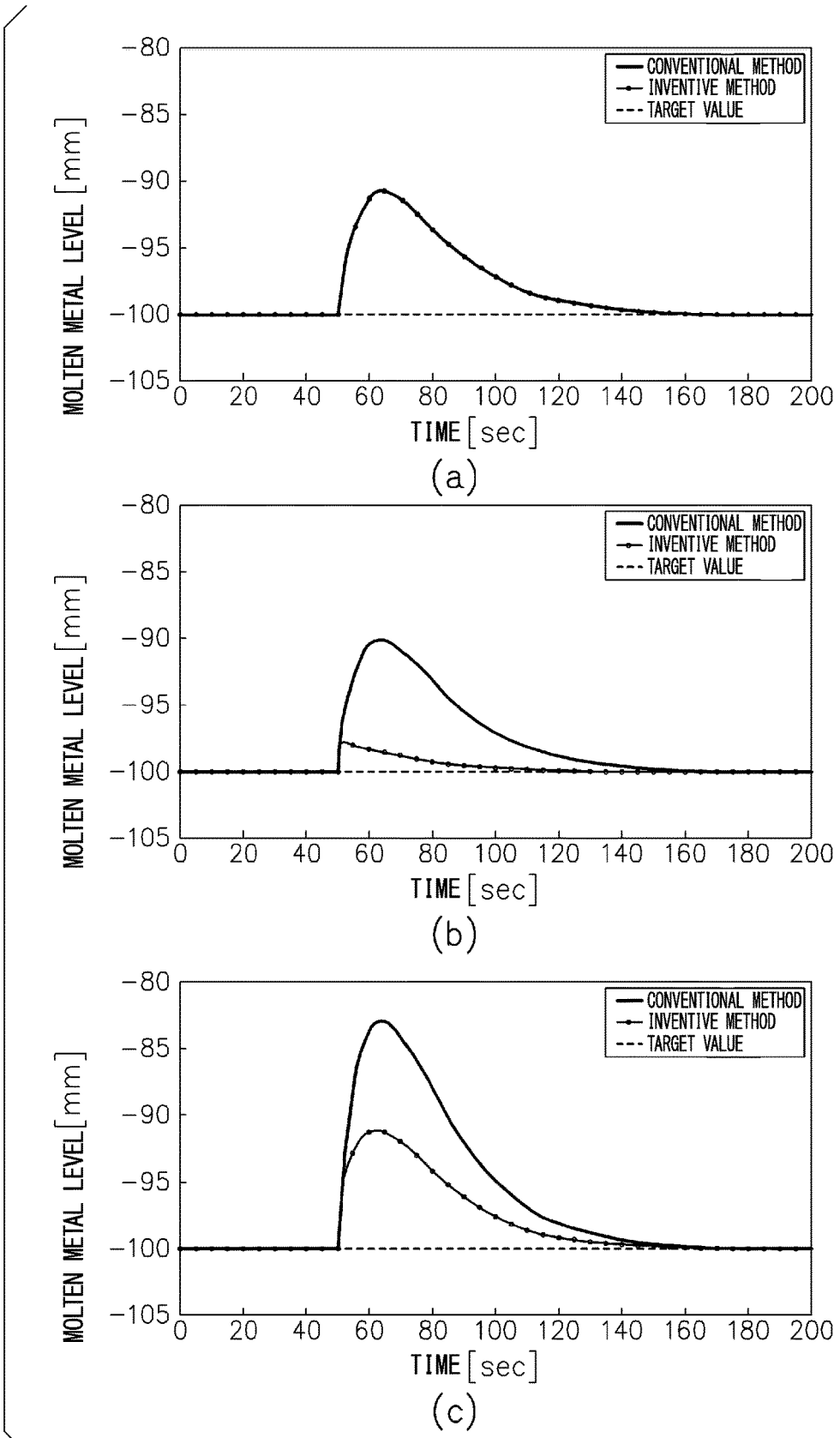
FIG. 5 is a characteristic diagram illustrating simulation results comparing an inventive method and a conventional method.
Figure 6:
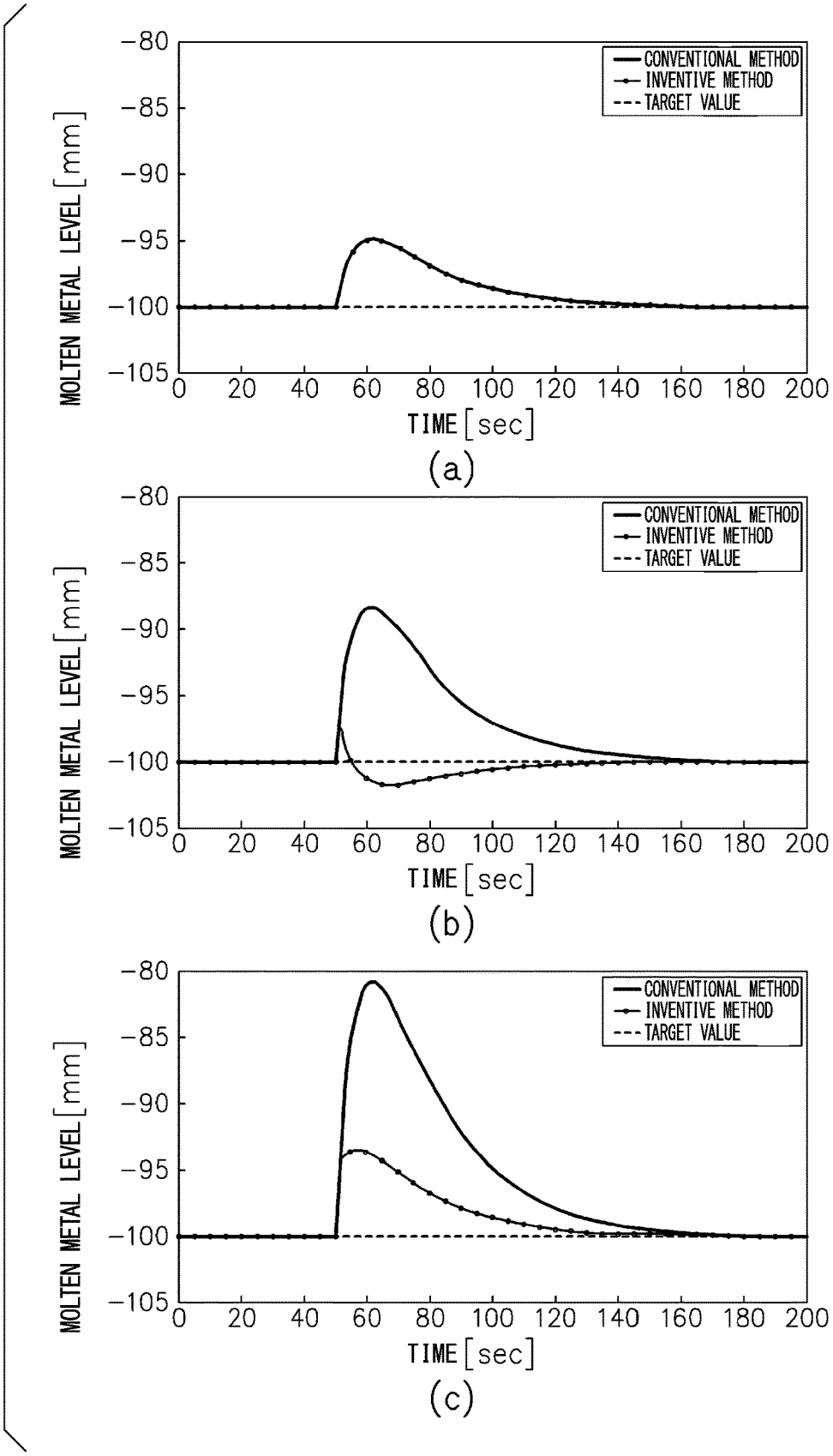
FIG. 6 is a characteristic diagram illustrating simulation results comparing an inventive method and a conventional method.

The molten metal level target value was set at a position of 100 mm (−100 mm) in the casting direction in the coordinate system having an original point at an upper end of the mold (refer to the target value indicated by the dotted line in FIG. 4 to FIG. 6.)

The main controller 101 was set with PI controller (proportional gain is 0.20, and integration time is 30 sec), the control cycle was set to 50 msec, and the PI control was implemented by a velocity type.

Further, the opening degree correction gains were set to $K_1$=0.3, and $K_2$=1.0, and the observer gains were set to $L_1$=1, and $L_2$=L1*A.

The flow rate characteristic model $P_0$ and its inverse model $P_0^{-1}$ were given by straight lines. Since the controller is implemented by the velocity type, there is no need to consider the intercept of the straight line; only the slope of the straight line may be set.

[Simulation Conditions]

The simulation in which the opening degree correction gain $K_{2=0}$ was set is a conventional method. By setting the opening degree correction gain $K_{2=0}$, this condition can simulate a state as same as the case in which a minor loop suppressing the extraction disturbance does not exist, thus, this simulation corresponds to the method as disclosed in the Patent Document 1. Then, between the inventive method and the conventional method, the molten metal level control results by the simulations were compared.

Here, it is difficult to preliminary and precisely grasp the plant flow rate characteristic P in the real plant, thus in the actual situation, an error happens in the flow rate characteristic model $P_0$ which is a nominal model. As the model error $\Delta$ of the flow rate characteristic model $P_0$, three-type cases are set; that is, $\Delta=0$ (no error), $\Delta<0$ (flow rate is hard to obtain), and $\Delta>0$ (flow rate is easy to obtain). Then, for each of the cases, simulations were performed for cases (a) in which the input disturbance $d_1$ occurred, (b) in which the extraction disturbance $d_2$ occurred, and (c) in which the input disturbance $d_1$ and the extraction disturbance $d_2$ were simultaneously occurred. As shown in FIG. 4 to FIG. 6 explained below, it was assumed that the input disturbance $d_1$ and the extraction disturbance $d_2$ are generated at the 50 sec time point. The volume fluctuation corresponding to flow rate 10% was considered for each disturbance. The model error $\Delta$ of the flow rate characteristic model $P_0$ was set to 20% decrease of the nominal value ($\Delta=-0.2$), and 20% increase of the nominal value ($\Delta=0.2$).

[Simulation Results]

FIG. 4 to FIG. 6 show the simulation results.

FIG. 4 shows results of the simulations in which the model error 4=0 (no error) was set in the flow rate characteristic model $P_0$. The graph (a) indicates a response of the molten metal level when the input disturbance $d_1$ occurred, the graph (b) indicates a response of the molten metal level when the extraction disturbance $d_2$ occurred, and the graph (c) indicates a response of the molten metal level when the input disturbance $d_1$ and the extraction disturbance $d_2$ were simultaneously occurred. As shown in the graph (a) of FIG. 4, when the input disturbance $d_1$ occurred, the same results were obtained in the conventional method and the inventive method. On the other hand, as shown in the graph (b) and the graph (c) in FIG. 4, when the extraction disturbance $d_2$ occurred, the molten metal level fluctuation was not suppressed by the conventional method, but the inventive method achieved to suppress the molten metal level fluctuation. In the conventional method, because it is impossible to distinguish the input disturbance $d_1$ and the extraction disturbance $d_2$ from each other, the effect of suppressing the molten metal level fluctuation deteriorates when the extraction disturbance $d_2$ occurred.

Further, FIG. 5 shows results of the simulations in which the model error $\Delta=-0.2$ (flow rate is hard to obtain) was set in the flow rate characteristic model $P_0$, and the same as the graphs (a) to (c) of FIG. 4, the graph (a) indicates a response of the molten metal level when the input disturbance $d_1$ occurred, the graph (b) indicates a response of the molten metal level when the extraction disturbance $d_2$ occurred, and the graph (c) indicates a response of the molten metal level when the input disturbance $d_1$ and the extraction disturbance $d_2$ were simultaneously occurred. Also in these simulations, in the conventional method, because it is impossible to distinguish the input disturbance $d_1$ and the extraction disturbance $d_2$ from each other, the effect of suppressing the molten metal level fluctuation deteriorates when the extraction disturbance $d_2$ occurred.

Further, FIG. 6 shows results of the simulations in which the model error $\Delta=0.2$ (flow rate is easy to obtain) was set in the flow rate characteristic model $P_0$, and as same as the graphs (a) to (c) of FIG. 4, the graph (a) indicates a response of the molten metal level when the input disturbance $d_1$ occurred, the graph (b) indicates a response of the molten metal level when the extraction disturbance $d_2$ occurred, and the graph (c) indicates a response of the molten metal level when the input disturbance $d_1$ and the extraction disturbance $d_2$ were simultaneously occurred. Also in these simulations, in the conventional method, because it is impossible to distinguish the input disturbance $d_1$ and the extraction disturbance $d_2$ from each other, the effect of suppressing the molten metal level fluctuation deteriorates when the extraction disturbance $d_2$ occurred.

As shown in FIG. 4 to FIG. 6, in any case of setting the model errors in the flow rate characteristic model $P_0$, as compared with the conventional method, the inventive method does not deteriorate the effect of suppressing the fluctuation of the molten metal level when the input disturbance $d_1$ and the extraction disturbance $d_2$ occurred.

Although the present disclosure is described above with the embodiment, the above-described embodiment merely illustrates examples of embodying the present disclosure, and the technical scope of the present disclosure cannot be construed in a limited manner by them. That is, the present disclosure may be implemented in various forms without departing from the technical idea or the main features thereof.

For example, another aspect of the present disclosure is a control method for a continuous casting process of continuously producing a slab by injecting a molten metal from a nozzle to a mold and extracting the molten metal while solidifying the molten metal, the control method including: a molten metal level measuring step of measuring a molten metal level in the mold by using a molten metal level meter, a main control step of obtaining an operation amount of a flow rate adjusting mechanism that adjusts a flow rate of the molten metal injected to the mold from the nozzle such that a molten metal level measured by the molten metal level measuring step follows a molten metal level target value, a flow rate measuring step of measuring the flow rate of the molten metal injected to the mold from the nozzle by a flowmeter, an input disturbance correcting step of obtaining a first correction amount for the operation amount of the flow rate adjusting mechanism obtained by the main control step, in accordance with an input disturbance estimation value obtained based on the flow rate measurement value of the molten metal measured in the flow rate measuring step, and an extraction disturbance correcting step of obtaining a second correction amount for the operation amount of the flow rate adjusting mechanism obtained by the main control step, in accordance with an extraction disturbance estimation value obtained based on the molten metal level measurement value measured by the molten metal level meter.

The control device of the continuous casting process to which the present disclosure is applied may be realized by a computer provided with a CPU, a ROM, a RAM and the like, for example.

The present disclosure may also be realized by supplying software (program) that implements functions of the present disclosure to a system or a device via a network or various storage media, and allowing a computer of the system or the device to read and execute the program.

Accordingly, further another aspect of the present disclosure is a program for controlling a continuous casting process of continuously producing a slab by injecting a molten metal from a nozzle to a mold and extracting the molten metal while solidifying the molten metal, the program configured to allow a computer to execute: a main control process of obtaining an operation amount of a flow rate adjusting mechanism that adjusts a flow rate of the molten metal injected to the mold from the nozzle such that a molten metal level measured by a molten metal level meter follows a molten metal level target value, an input disturbance correcting process of obtaining a first correction amount for the operation amount of the flow rate adjusting mechanism obtained by the main control process, in accordance with an input disturbance estimation value obtained based on the flow rate measurement value of the molten metal measured by the flowmeter, and an extraction disturbance correcting process of obtaining a second correction amount for the operation amount of the flow rate adjusting mechanism obtained in the main control process, in accordance with an extraction disturbance estimation value obtained based on the molten metal level measurement value measured by the molten metal level meter, or a computer-readable recording medium recording the same.

FIELD OF INDUSTRIAL APPLICATION

According to the present disclosure, it is possible to accurately control a molten metal level in a mold in a case where a plurality of disturbances occurred in the continuous casting process.

BRIEF DESCRIPTION OF THE REFERENCE SYMBOLS

1: mold
2: immersion nozzle
3: molten metal level meter
4: in-nozzle flowmeter
5: sliding gate
100: control device for a continuous casting process
101: main controller
102: flow rate estimation unit
103: input disturbance correction unit
104: disturbance observer
105: extraction disturbance correction unit

What is claimed is:

1. A control device for a continuous casting process which is configured to continuously produce a slab by injecting a molten metal from a nozzle to a mold and extracting the molten metal while solidifying the molten metal, the control device comprising:

a molten metal level meter that is configured to measure a molten metal level in the mold, a main control unit that is configured to obtain an operation amount of a flow rate adjusting mechanism that adjusts a flow rate of the molten metal injected to the mold from the nozzle such that the molten metal level measured by the molten metal level meter follows a molten metal level target value, a flowmeter that is configured to measure the flow rate of the molten metal injected to the mold from the nozzle, an input disturbance correction unit that is configured to obtain a first correction amount for the operation amount of the flow rate adjusting mechanism obtained by the main control unit, in accordance with an input disturbance estimation value obtained according to a flow rate measurement value of the molten metal measured by the flowmeter, and an extraction disturbance correction unit that is configured to obtain a second correction amount for the operation amount of the flow rate adjusting mechanism obtained by the main control unit, in accordance with an extraction disturbance estimation value obtained according to a molten metal level measurement value measured by the molten metal level meter.

2. The control device for a continuous casting process according to claim 1, further comprising:

a flow rate estimation unit that is configured to calculate a flow rate estimation value of a molten metal associated with an opening degree using a flow rate characteristic model indicating a relationship between the operation amount of the flow rate adjusting mechanism and the flow rate of the molten metal, wherein the input disturbance correction unit is configured to use a difference between the flow rate measurement value of the molten metal measured by the flowmeter and a flow rate estimation value of the molten metal calculated by the flow rate estimation unit as the input disturbance estimation value, and obtain the first correction amount according to the input disturbance estimation value.

3. The control device for a continuous casting process according to claim 2, wherein the input disturbance correction unit is configured to obtain the first correction amount by using an inverse model of the flow rate characteristic model.

4. The control device for a continuous casting process according to claim 2, wherein the extraction disturbance correction unit is configured to obtain the second correction amount by using an inverse model of the flow rate characteristic model.

5. The control device for a continuous casting process according to claim 1, comprising an extraction disturbance estimation unit that is configured to obtain the extraction disturbance estimation value by configuring a state observer in which the molten metal level and an extraction disturbance are state variables, using a process model indicating a response to the molten metal level with respect to a flow rate of the molten metal, using the flow rate measurement value of the molten metal measured by the flowmeter and the molten metal level measurement value measured by the molten metal level meter as inputs, wherein the extraction disturbance correction unit is configured to obtain the second correction amount in accordance with the extraction disturbance estimation value obtained by the extraction disturbance estimation unit.

6. The control device for a continuous casting process according to claim 5, wherein the state observer is a Luenberger observer.

7. The control device for a continuous casting process according to claim 1, wherein the flowmeter is an electromagnetic flowmeter.

8. A control method for a continuous casting process of continuously producing a slab by injecting a molten metal from a nozzle to a mold and extracting the molten metal while solidifying the molten metal, the control method comprising:

a molten metal level measuring process of measuring a molten metal level in the mold by using a molten metal level meter, a main control process of obtaining an operation amount of a flow rate adjusting mechanism that adjusts a flow rate of a molten metal injected to the mold from the nozzle such that the molten metal level measured in the molten metal level measuring process follows a molten metal level target value, a flow rate measuring process of measuring the flow rate of the molten metal injected to the mold from the nozzle by a flowmeter, an input disturbance correcting process of obtaining a first correction amount for the operation amount of the flow rate adjusting mechanism obtained by the main control process, in accordance with an input disturbance estimation value obtained according to the flow rate measurement value of the molten metal measured in the flow rate measuring process, and an extraction disturbance correcting process of obtaining a second correction amount for the operation amount of the flow rate adjusting mechanism obtained by the main control process, in accordance with an extraction disturbance estimation value obtained according to a molten metal level measurement value measured by the molten metal level meter.

9. A non-transitory computer readable storage medium encoded with computer readable instructions, which, when executed by processor circuitry, causes the processor circuitry to perform a method for controlling a continuous casting process of continuously producing a slab by injecting a molten metal from a nozzle to a mold and extracting the molten metal while solidifying the molten metal, the method comprising:

a main control process of obtaining an operation amount of a flow rate adjusting mechanism that adjusts a flow rate of the molten metal injected to the mold from the nozzle such that a molten metal level measured by a molten metal level meter follows a molten metal level target value, an input disturbance correcting process of obtaining a first correction amount for the operation amount of the flow rate adjusting mechanism obtained by the main control process, in accordance with an input disturbance estimation value obtained according to the flow rate measurement value of the molten metal measured by the flowmeter, and an extraction disturbance correcting process of obtaining a second correction amount for the operation amount of the flow rate adjusting mechanism obtained by the main control process, in accordance with an extraction disturbance estimation value obtained according to a molten metal level measurement value measured by the molten metal level meter.

* * * * *